US008091466B2

(12) United States Patent
Kneppler et al.

(10) Patent No.: US 8,091,466 B2
(45) Date of Patent: Jan. 10, 2012

(54) BREECH PORTION FOR A REPEATING RIFLE

(75) Inventors: Mathias Kneppler, Burgberg (DE); Josef Rauch, Argenbühl (DE); Hans-Peter Schwärzler, Weiler (DE); Jürgen Rothärmel, Altusried (DE); Christian Scherpf, Obersfeld (DE)

(73) Assignee: Blaser Finanzholding GmbH, Isny (DE)

( * ) Notice: Subject to any disclaimer, the term of this patent is extended or adjusted under 35 U.S.C. 154(b) by 192 days.

(21) Appl. No.: 12/480,103

(22) Filed: Jun. 8, 2009

(65) Prior Publication Data

US 2009/0308241 A1 Dec. 17, 2009

(30) Foreign Application Priority Data

Jun. 11, 2008 (DE) ..... 10 2008 027 709

(51) Int. Cl.
*F41A 3/50* (2006.01)

(52) U.S. Cl. ..... 89/190; 42/16

(58) Field of Classification Search ..... 89/180, 89/164, 168, 175, 176, 189, 190; 42/16
See application file for complete search history.

(56) References Cited

U.S. PATENT DOCUMENTS

| | | | | | |
|---|---|---|---|---|---|
| 1,095,738 | A * | 5/1914 | Rostel | 89/144 |
| 2,370,189 | A * | 2/1945 | Penney | 89/152 |
| 2,590,981 | A * | 4/1952 | Lippert et al. | 89/190 |
| 2,775,166 | A * | 12/1956 | Janson | 89/190 |
| 2,861,374 | A * | 11/1958 | Hampton | 42/16 |
| 3,613,282 | A * | 10/1971 | Ramsay | 42/17 |
| 4,227,439 | A * | 10/1980 | Gillum | 89/190 |
| 4,815,356 | A * | 3/1989 | Hupp et al. | 89/190 |
| 5,458,046 | A * | 10/1995 | Blenk et al. | 89/190 |
| 5,682,007 | A * | 10/1997 | Dobbins | 89/187.02 |
| 6,622,609 | B1 * | 9/2003 | Barkan | 89/180 |
| 6,820,533 | B2 * | 11/2004 | Schuerman | 89/190 |
| 7,478,494 | B2 * | 1/2009 | Zeh | 42/25 |
| 2007/0012170 | A1 * | 1/2007 | Spielberger | 89/196 |

FOREIGN PATENT DOCUMENTS

DE 4305700 C1 10/1994

* cited by examiner

*Primary Examiner* — Stephen M Johnson
(74) *Attorney, Agent, or Firm* — Martin Fleit; Paul D. Bianco; Fleit Gibbons Gutman Bongini & Bianco, PL

(57) ABSTRACT

The invention relates to a breech for a repeating rifle with a lock guide, a bolt head arranged in the lock guide, a locking sleeve arranged concentrically with the bolt head with several locking elements that can be moved by an expansion device between an inner unlocked position and an outer locked position, and a locking lever that is arranged in the lock guide and that can be activated by means of a bolt handle with which is associated a first cam element that is arranged so that it can rotate in the lock guide with a rear contact surface for support against a fixed control element. To allow especially smooth-running and safe locking action, a second cam element, which can rotate independently of the first cam element and that has a rear control cam for support against the fixed control element is associated with the locking lever.

7 Claims, 10 Drawing Sheets

BREECH PORTION FOR A REPEATING RIFLE

CROSS REFERENCE TO RELATED APPLICATION

This application claims priority under 35 U.S.C. §119 to German Patent Application No. 10 2008 027 709.6 filed Jun. 11, 2008, the entire contents of which are incorporated herein by reference.

FIELD OF THE INVENTION

The present invention relates to a breech for a repeating rifle. The invention also relates to a receiver for such a breech.

BACKGROUND OF THE INVENTION

A breech of a repeating rifle of this type is known from DE 43 05 700 C1. In that document, a bolt head and a locking sleeve arranged concentrically about this bolt head are arranged within a locking guide that is displaceable on a receiver. The locking sleeve constructed as an expansion sleeve is divided at its front end into several flexible spring tongues by longitudinal slots. The spring tongues have locking elements at their front ends for engaging in an annular groove on the inside of the barrel. By means of an expansion cone provided on the bolt head, the locking elements constructed integrally with the spring tongues of the locking sleeve can move between a radially inner unlocked position and a radially outer locked position. For this known breech, the advance of the lock guide that is displaceably arranged on a receiver is controlled by an individual cam element arranged so that it can rotate in the lock guide.

SUMMARY OF THE INVENTION

The task of the invention is to create a breech for a repeating rifle and an associated receiver that permit an especially smooth-running and reliable bolt action.

This task is achieved by a breech as set forth below and by an associated receiver as also set forth below.

Preferred improvements and advantageous embodiments of the invention are also set forth below.

In the breech according to the invention, the displacement of the lock guide relative to the receiver necessary for activating the breech is achieved by two cam elements led alternately into engagement with a fixed control element. By means of the first cam element, safe locking of the breech can be guaranteed with high force transmission, while by means of the second cam element, through the additional control cam provided there, the axial displacement needed for the insertion of the bolt head into the barrel is also achieved with a small pivoting motion of the locking lever. The first cam element is constructed such that it provides, by means of corresponding lever ratios, good force transmission when the locking sleeve is expanded for moving the locking elements into the locked position. In contrast, the shape of the second cam element with the additional control cam is selected so that, just through a small rotation of the locking lever, a comparatively large axial displacement of the lock guide relative to the receiver can be generated. By dividing the advancement onto two separate cam elements, a uniform advance motion is enabled with low expenditure of force.

In one construction that is advantageous with respect to structure and production, the two cam elements are supported so that they can rotate freely on a common transverse shaft arranged in the lock guide.

The two cam elements preferably each have a rear control shoulder for engaging with control surfaces on the fixed control element and a front catch tab for engaging with the locking lever.

The expansion device for moving the locking elements between the inner unlocked position and the outer locked position is made, in a preferred construction, from a support sleeve that is connected by means of a shoulder to the locking lever and that is led, with a front end in contact with ramp beveling, onto spring tongues of the locking sleeve formed as an expansion sleeve and supports the locking elements in the locked position over a large surface area. In this way, a particularly stable and safe locking is achieved.

The receiver belonging to the breech contains side guide grooves for the displaceable guidance of a lock guide of the breech, wherein there are two control surfaces on the receiver for engaging with the two cam elements arranged one next to the other in the lock guide for activation of the breech.

BRIEF DESCRIPTION OF THE FIGURES

Other special features and advantages of the invention emerge from the following description of a preferred embodiment with reference to the drawing. Shown are.

DETAILED DESCRIPTION OF THE INVENTION

Figure 1:
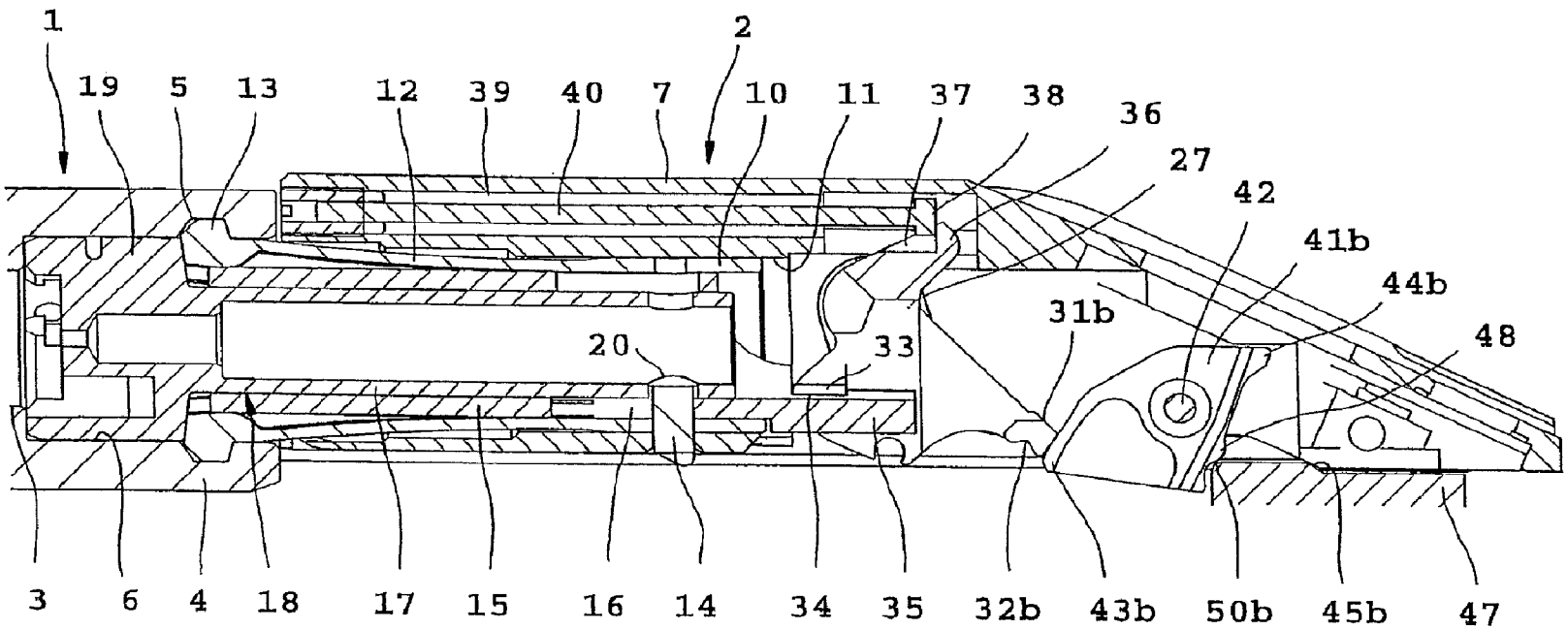
FIG. 1: the rear part of a barrel and a locked breech of a repeating rifle in a longitudinal section.

In FIG. 1, the rear part of a barrel 1 and a breech 2 of a repeating rifle in a locked position are shown. On its rear end, the barrel 1 has a cartridge holder 3 and a locking head 4 with a locking groove 5 on the inner wall of a receiving hole 6.

Figure 2:
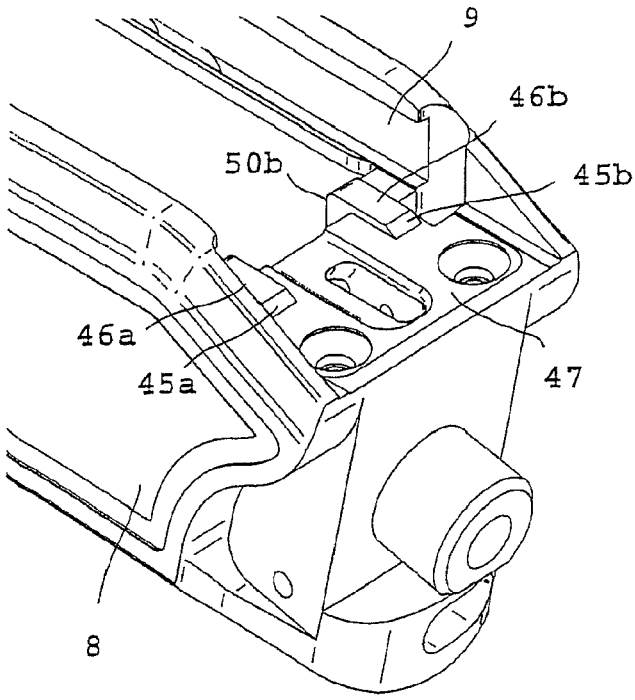
FIG. 2: a part of a receiver of a repeating rifle in a perspective view from the rear.
Figure 3:
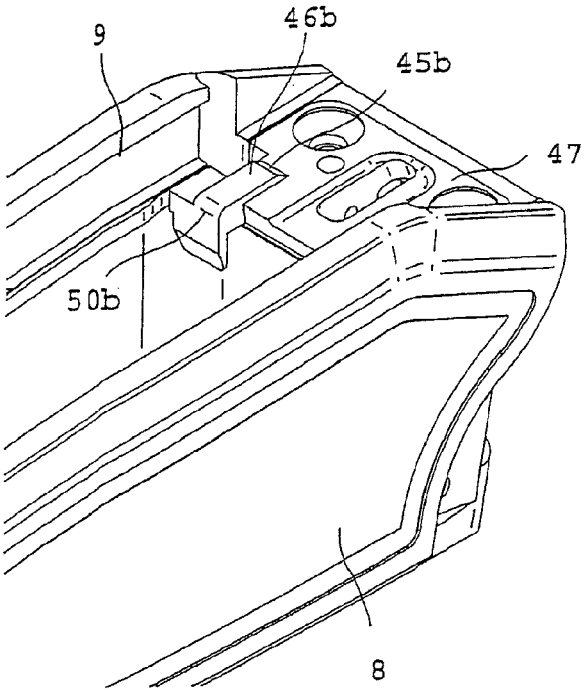
FIG. 3: a part of the receiver of FIG. 2 in a perspective view from the front.

The breech 2 contains a lock guide 7 that is constructed as a slide and that is guided so that it can move on a receiver 8 shown partially in FIGS. 2 and 3 by means of side longitudinal guides 9. The breech 2 further contains a locking sleeve 10 that is constructed here as an expansion sleeve and that is arranged in a hole 11 expanded frontwards with a step shape in the lock guide 7 and that contains, at its front part, several spring tongues 12 divided by longitudinal slots. At their front end, the spring tongues 12 have locking elements 13 in the form of thicker sections for engaging in the locking groove 5 of the barrel 1.

The locking sleeve 10 is fixed in the axial direction by a safety piece constructed as a chamber holder 14 within the lock guide 7. Within the locking sleeve 10, a support sleeve 15 that is coaxial with this locking sleeve is guided so that it can move in the axial direction by a predetermined amount. For this purpose, the support sleeve 15 has, in the region of the chamber holder 14, a recess 16. The displacement of the locking sleeve 10 is limited by the dimensions of the recess 16. Within the support sleeve 15, the rear, narrower part 17 of an essentially cylindrical bolt head 18 is arranged coaxial with the support sleeve 15. The rear part 17 of the bolt head 18 is thus surrounded coaxially by the locking sleeve 10, wherein the axially displaceable support sleeve 15 is arranged between the rear part 17 of the bolt head 18 and the locking sleeve 10.

The bolt head 18 further has, in addition to the narrower rear part 17, a breech head 19 that is enlarged and projects frontwards relative to the locking sleeve 10 and the lock guide 7 for engaging in the receptacle borehole 6 of the locking head 4 at the end of the barrel 1. In the narrower, rear part 17 of the bolt head 18 there is a side opening 20 for engaging the chamber holder 14. The side opening 20 in the bolt head 18 is somewhat larger than the chamber holder 14, so that the bolt head 18 can move in the axial direction by a small amount relative to the lock guide 7. In a known way, the firing pin and an associated firing-pin spring are housed in the bolt head 18. The firing pin and the firing pin spring are not shown because their arrangement within the bolt head 18 is known.

Figure 4:
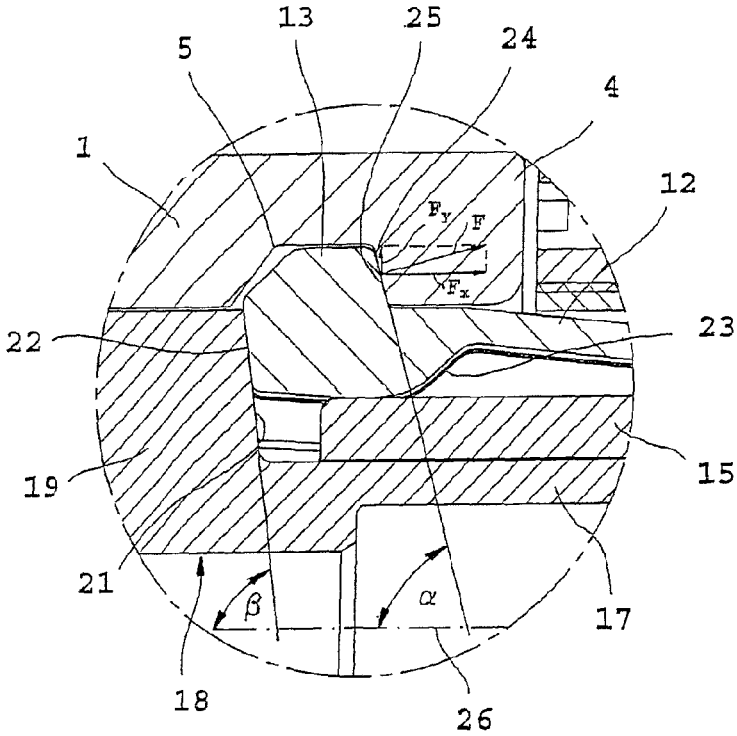
FIG. 4: the front region of a bolt head of the breech shown in FIG. 1 in an enlarged partial view.

From the enlarged partial view of the front region of the bolt head 18 according to FIG. 4 it emerges that the bolt head 18 has, on the rear side of the breech head 19 enlarged in diameter, in the transition region to the narrower rear part 17, a conical, rear abutment surface 21 for front, cone segment-shaped contact surfaces 22 on the locking elements 13 at the end of the spring tongues 12 of the locking sleeve 10. The spring tongues 12 contain, on the inside in the region of the transition to the locking elements 13, inner ramp beveling 23 for spreading apart the spring tongues 12 by the support sleeve 15. Through a forward movement of the support sleeve 15, the spring tongues 12 could thus be spread apart and the locking elements could be moved from an unlocked position shown in FIG. 6 into a locked position shown in FIG. 1. The locking elements 13 contain backwards directed, rear cone segment-shaped contact surfaces 24 that interact in the locked position shown in FIG. 4 with a rear locking surface 25 on the rear side of the locking groove 5 in the locking head 4 of the barrel 1. The rear locking surface 25 of the barrel 1 has, relative to the center axis 26 of the barrel 1 and the bolt head 18, a relatively steep angle $\alpha$ of 70° to 80°, advantageously 75°. The rear contact surfaces 24 are constructed so that, in the locked position, these also assume the angle $\alpha$ and thus form a planar contact on the locking surface 25 of the barrel 1. The conical abutment surface 21 of the bolt head 18 is inclined, relative to the center axis 26 of the barrel 1 and the bolt head 18, by an angle $\beta$ between 80° and 85°, advantageously 83°. The cone-segment-shaped, front contact surfaces of the locking elements 13 on the end of the spring tongues 12 are also inclined at the angle $\beta$ to the center axis 26. Through the steep construction of the locking surface 25 in the locking groove 5 of the barrel 1, pressure forces F acting on the barrel 1 during the discharge of a shot by the locking elements 13 have a relatively large component Fx in the axial direction and only a relatively small component Fy in the radial direction, as shown by the arrows in FIG. 4. In this way, a pressure-generated expansion of the barrel end can be prevented, and thus the stability of the locking can be improved.

Figure 5:
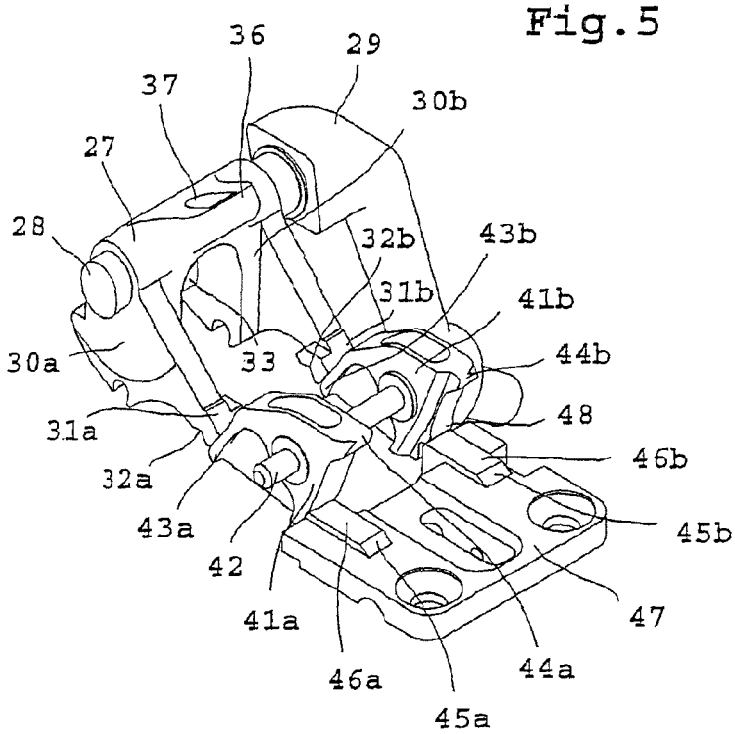
FIG. 5: a locking lever with cam elements of the breech shown in FIG. 1 in a perspective view.

In the lock guide 7, a locking lever 27, shown in perspective in FIG. 5, is mounted so that it can rotate about an axis 28 running perpendicular to the lock guide 7. The locking lever 27 can be activated by a bolt handle 29 and contains, on the bottom side, two parallel legs 30*a* and 30*b* that each have a backwards projecting locking shoulder 31*a* or 31*b* with a recess 32*a* or 32*b* in the bottom side. On the inside of the right leg 30*b* there is an inwards projecting shoulder 33 for the positive-fit engagement in a recess 34, which can be seen in FIG. 1, in a rear projection 35 of the support sleeve 15. On the top side, the locking lever 27 contains a tab 36 with a recess 37 in which engages a head 38, shown in FIG. 1, of an unlocking pin 40 guided so that it can move in a longitudinal direction in a longitudinal hole 39 of the lock guide 7. By means of the rear locking shoulders 31*a* and 31*b*, the locking lever 27 is engaged with two cam elements 41*a* or 41*b* that are arranged one next to the other and that are arranged on a common transverse shaft 42 so that they can rotate in the lock guide 7 and receive a force in the clockwise direction from not-shown springs. The cam elements 41*a* and 41*b* constructed as cam discs each contain a front catch tab 43*a* and 43*b* for engaging the recess 32*a* or 32*b* of the locking lever 27 and a rear control shoulder 44*a* or 44*b* for engaging with control surfaces 45*a* and 45*b* on the receiver 8. In the shown embodiment, the control surfaces 45*a* and 45*b* are formed on raised sections 46*a* and 46*b* of a control element 47 mounted on the receiver 8. In the shown embodiment, the control element 47 is constructed as a control plate that is screwed tight on the receiver 8. On the cam element 41*b* on the right in FIG. 5, another control cam 48 is provided on the rear side. Below, the function of the breech will be explained with reference to FIGS. 6 to 12, wherein the left cam element 41*a* is shown in each of FIGS. 6*a* to 12*a*, and the right cam element 41*b* is shown in each of FIGS. 6*b* to 12*b*.

Figure 6B:
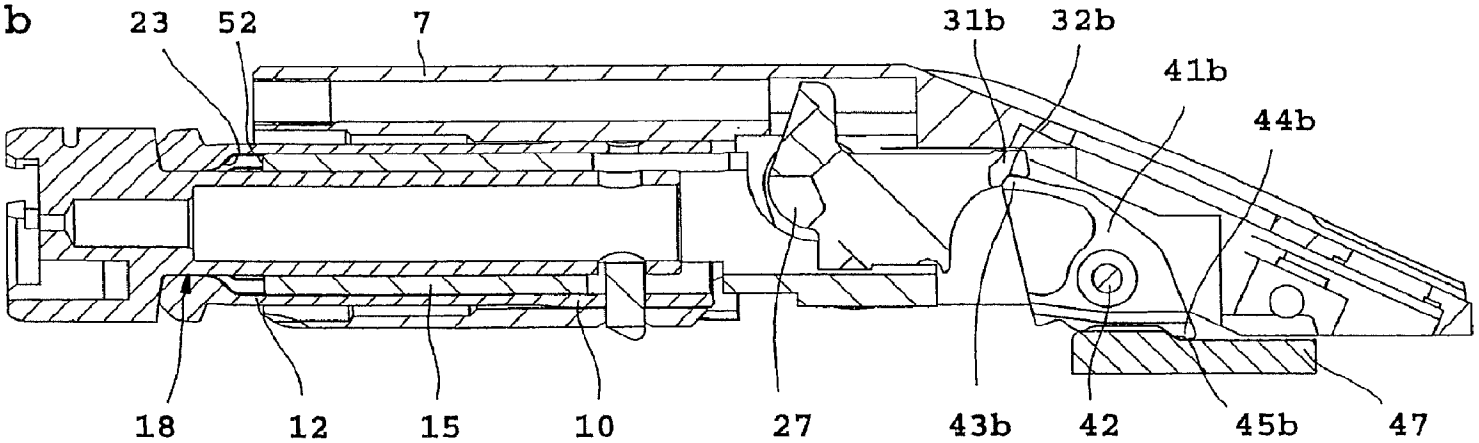
FIGS. 6*a*, 6*b*: the breech of FIG. 1 shortly before the unlatching of the cam elements on the locking lever.
Figure 6A:
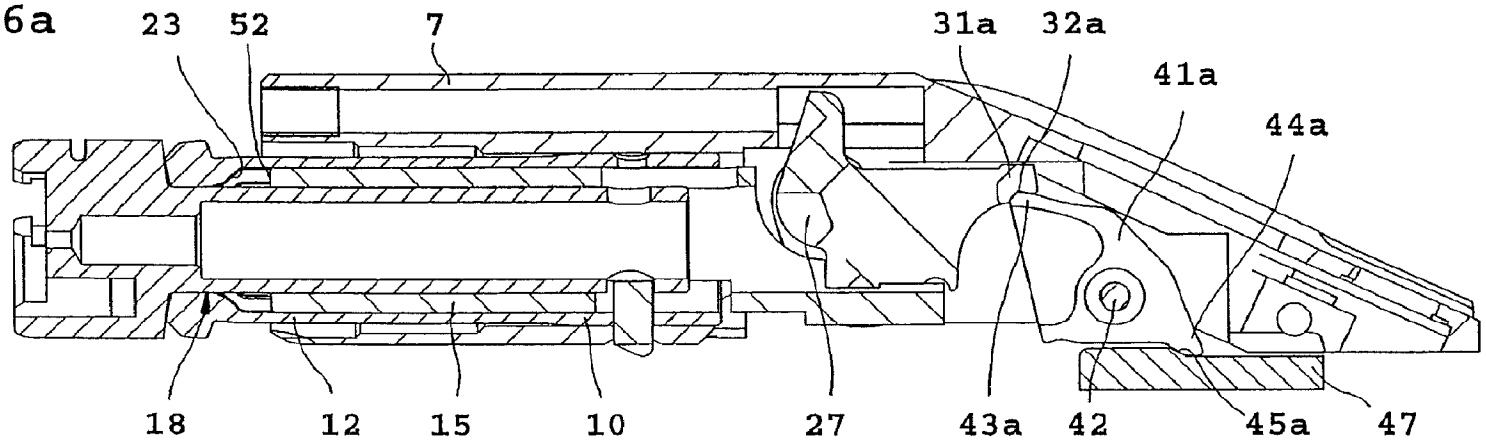

In the open position of the breech 2 shown in FIGS. 6*a* and 6*b*, the bolt handle 29 is pivoted backward, by means of which the rear locking shoulders 31*a* and 31*b* of the locking lever 27 are rotated upward and the front catch tabs 43*a* and 43*b* of the cam elements 41*a* or 41*b*, biased in the clockwise direction by springs, engage in the recesses 32*a* or 32*b* on the locking shoulders 31*a* and 31*b* of the locking lever 27. However, also on only one of the locking shoulders 31*a* or 31*b*, a recess 32*a* or 32*b* could be provided in which an associated catch tab 43*a* or 43*b* of the cam element 41*a* or 41*b* can engage in a locking way. Through this locking, the bolt handle 29 is blocked against rotation and the lock guide 7 can be pushed backward and frontward within the guide 9 of the receiver 8 shown in FIG. 2 with the help of the bolt handle 29. In the open position of the breech 2 the support sleeve 15 is located in a retracted position in which a front end 52 of the support sleeve 15 is spaced apart from the inner ramp beveling 23 on the spring tongues 12 of the locking sleeve 10. The spring tongues 12 of the locking sleeve 10 are therefore located in an unlocked position pivoted inward.

Figure 7B:
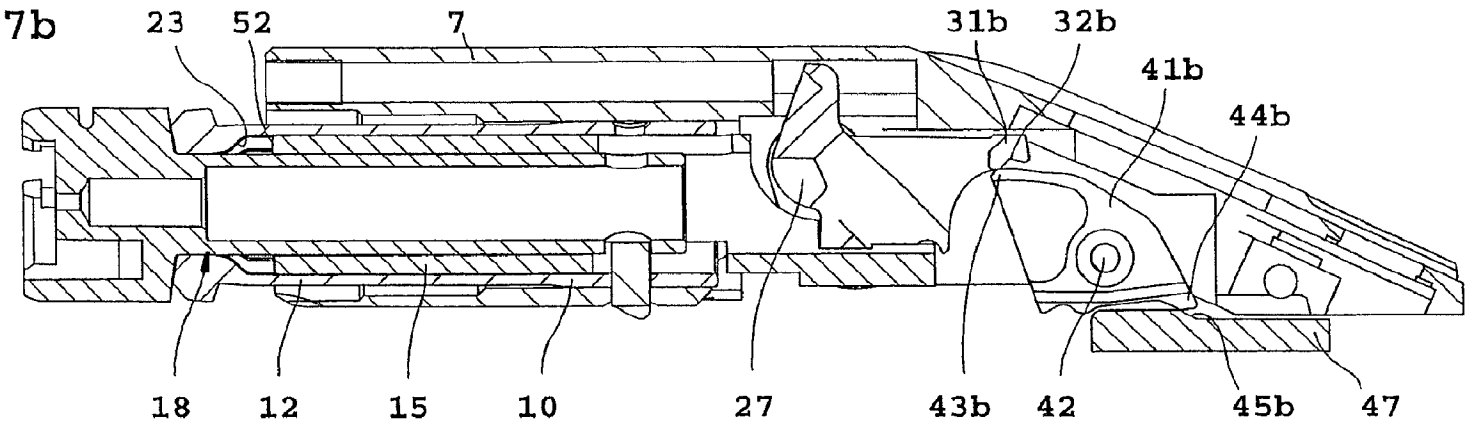
FIGS. 7*a*, 7*b*: the breech of FIG. 1 during the advancement by the cam elements.
Figure 7A:
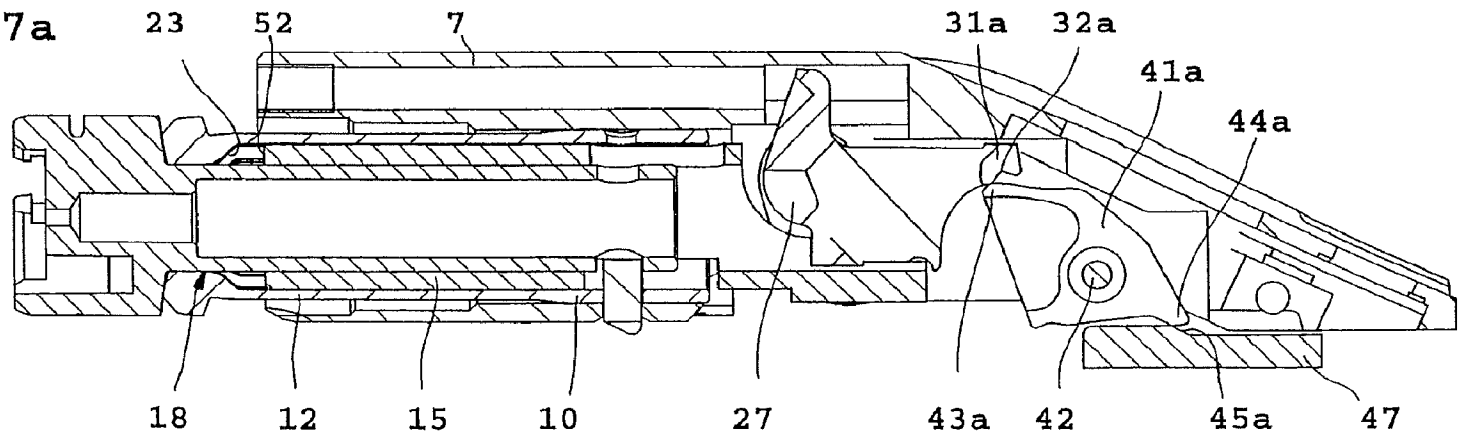

When the lock guide 7 is pushed farther forward relative to the control plate 47, fixedly arranged on the receiver 8, past the position shown in FIGS. 6*a* and 6*b*, the two rear control shoulders 44*a* and 44*b* of the cam elements 41*a* and 41*b* according to FIGS. 7*a* and 7*b* are lifted by the beveled control surfaces 45*a* and 45*b*, by means of which the front catch tabs 43*a* and 43*b* are led out of the recesses 32*a* or 32*b* and the lock between the cam elements 41*a* and 41*b* and the locking lever 27 is released. Thus, the bolt handle 29 can be pivoted frontwards.

Figure 8B:
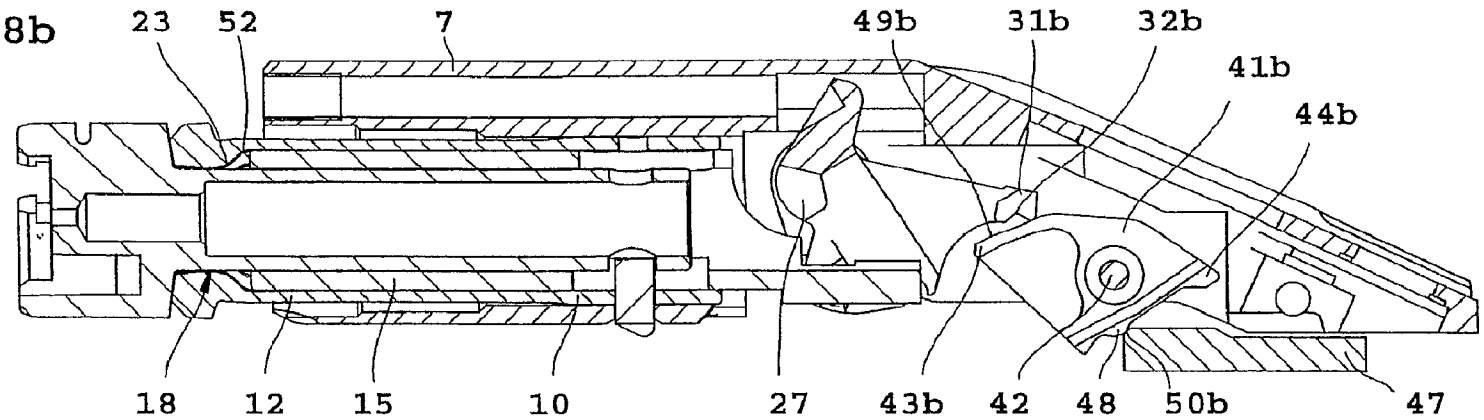
FIGS. 8*a*, 8*b*: the breech of FIG. 1 shortly before the expansion of the locking sleeve by the support sleeve.
Figure 8A:
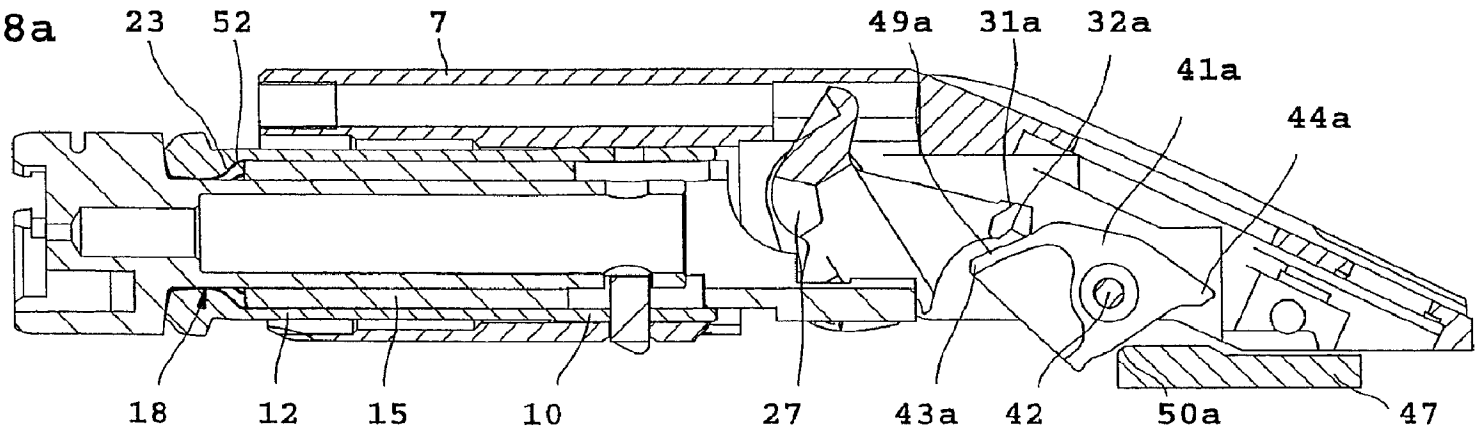

For the forward pivoting of the bolt handle 29 and the resulting rotation of the locking lever 27, the locking shoulders 31*a* and 31*b* press onto a front, beveled surface 49*a* or 49*b* of the cam elements 41*a* and 41*b*, by means of which the front catch tabs 43*a* and 43*b* according to FIGS. 8*a* and 8*b* are pressed downward until the control cam 48 on the right cam element 41*b* according to FIG. 8*b* is led into contact with a front edge 50*b* of the raised section 46*b*. In contrast, in this position the left cam element 41*a* does not yet contact the front edge 50*a* of the raised section 46*a*, as can be seen from FIG. 8*a*.

Figure 9B:
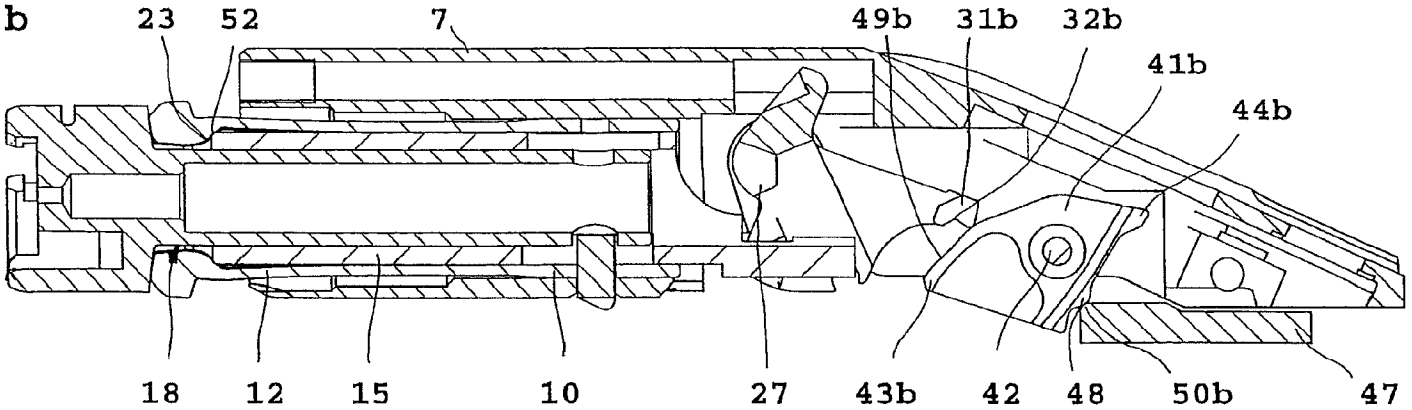
FIGS. 9*a*, 9*b*: the breech of FIG. 1 at the beginning of the expansion of the locking sleeve by the support sleeve.
Figure 9A:
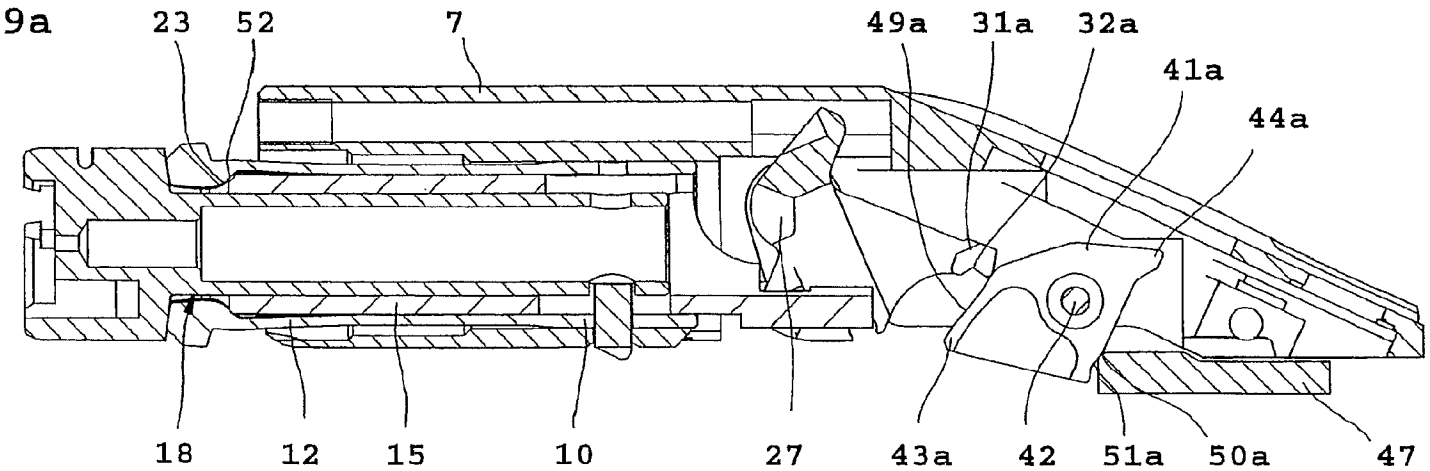

Through the further rotation of the locking lever 27 according to FIGS. 9*a* and 9*b*, the two cam elements 41*a* and 41*b* are further rotated by means of the contact of the locking shoulders 31*a* and 31*b* on the front surfaces 49*a* or 49*b* of the cam elements 41*a* and 41*b* until the left cam element 41*a* according to FIG. 9*a* with a rear surface Ma is led into contact on the front edge 50*a* of the raised section 46*a*. Simultaneously, the right cam element 41*b* is led out of engagement with the control plate 47, so that the further advance of the lock guide 7 is taken over by the left cam element 41*a*. In this phase, the support sleeve 15 is also pushed forward by means of the locking lever 27 until its front end 52 comes into contact with the ramp beveling 23 on the spring tongues 12 of the locking sleeve 10 constructed as an expansion sleeve.

Figure 10B:
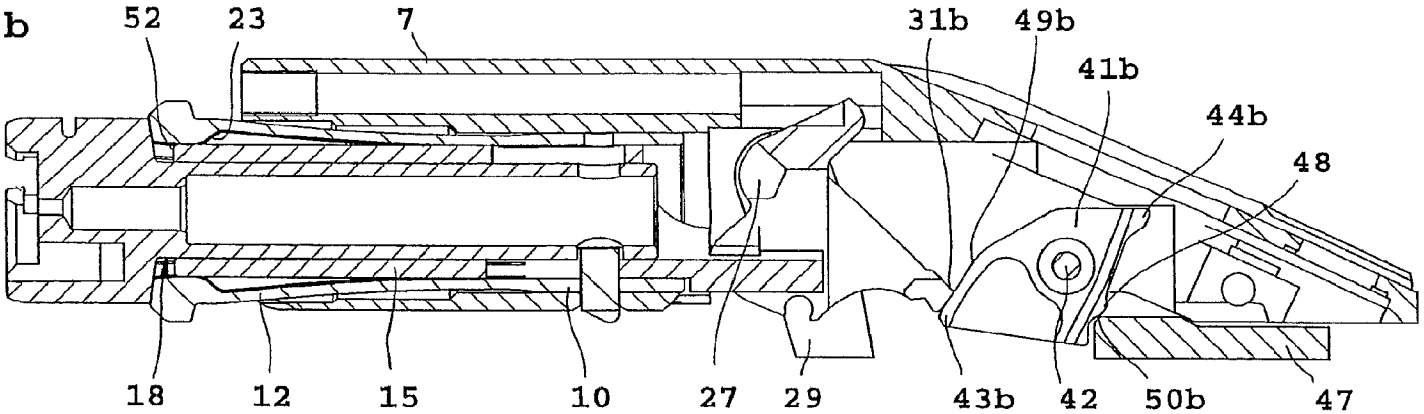
FIGS. 10*a*, 10*b*: the breech of FIG. 1 in the locked position.
Figure 10A:
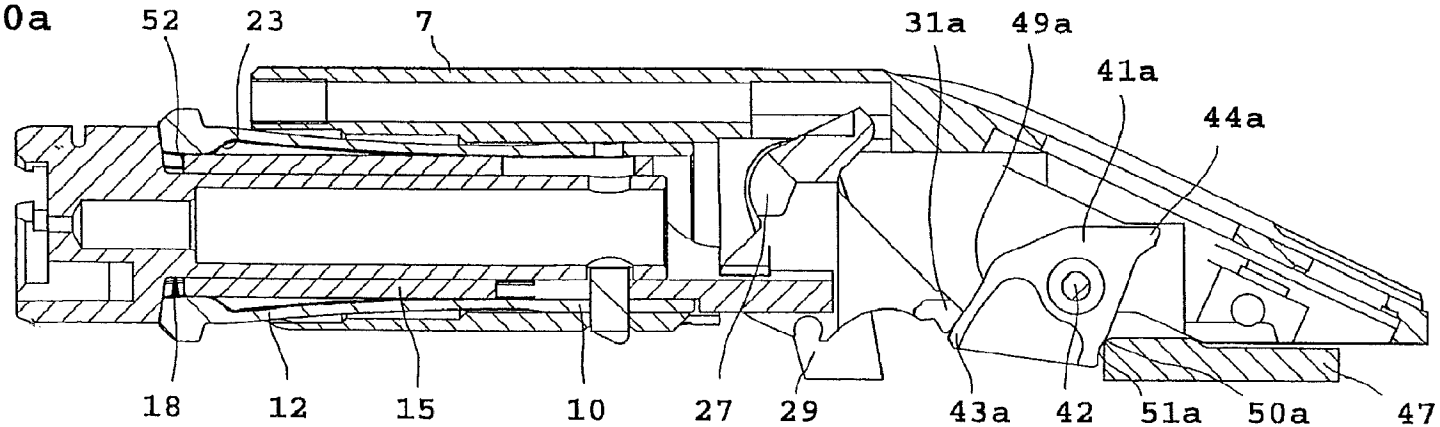
Figure 11B:
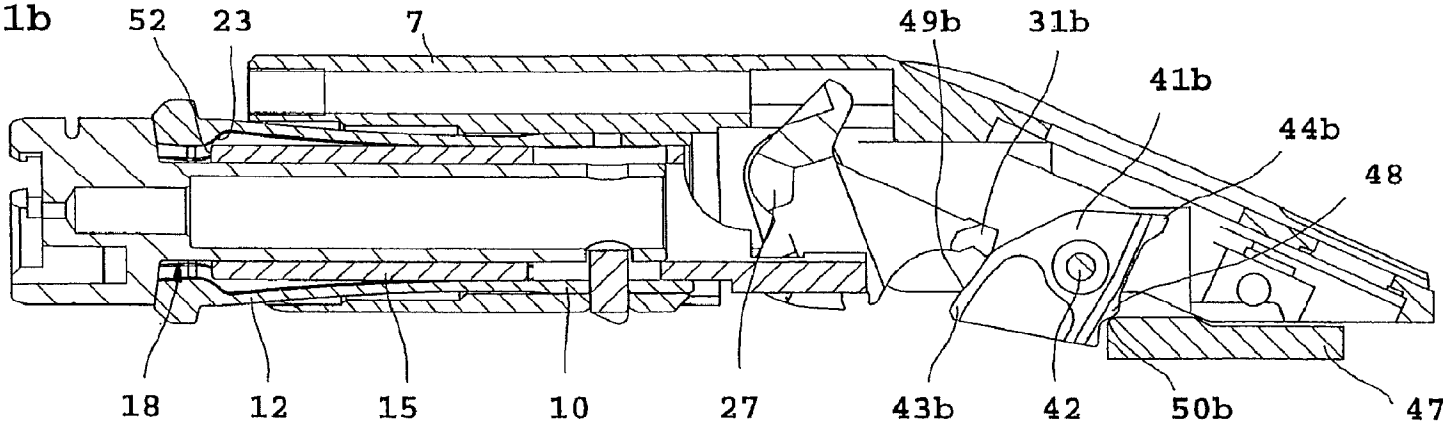
FIGS. 11*a*, 11*b*: the breech of FIG. 1 at the beginning of the opening process.
Figure 11A:
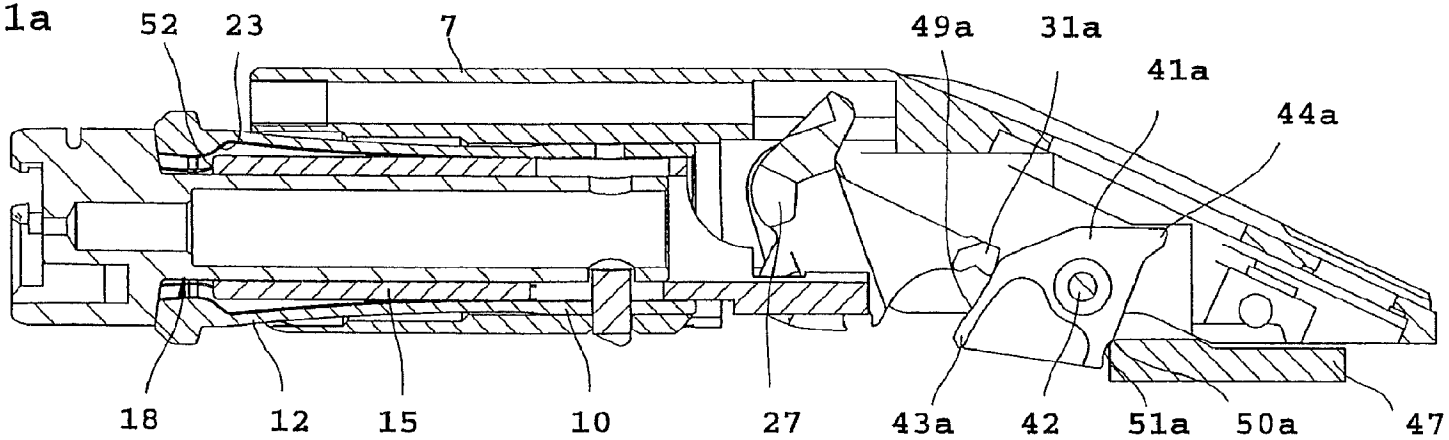

If the locking lever 27 is rotated farther, due to the forward pivoting of the bolt handle 29, into the locking position shown in FIGS. 10*a* and 10*b*, the front catch tabs 43*a* and 43*b* of the cam elements 41*a* and 41*b* are lowered farther due to the contact of the locking shoulders 31*a* and 31*b* of the locking lever 27 against the beveled, front surfaces 49*a* or 49*b* of the cam elements 41*a* and 41*b*, wherein the lock guide 7 is shifted somewhat forward by the left cam element 41*a*. Simultaneously, the support sleeve 15 is pushed farther forward by means of the shoulder 33, which can be seen in FIG. 5, under the thicker sections 13, so that the spring tongues 12 of the locking sleeve 10 are expanded outward and the thicker sections 13 are led into the annular groove 5 of the barrel 1, as is shown in FIGS. 1 and 4. In this way, secure locking is achieved.

For opening the breech 2, the bolt handle 29 is retracted and thus the locking lever 27 is rotated for raising the rear locking shoulders 31*a* and 31*b*. As emerges from FIGS. 11*a* and 11*b*, the right cam element 41*b* is first rotated for lowering the control shoulder 44*b*, while the left cam element 41*a* remains in the locked position and the lock guide 7 stops in the front position. Through the rotation of the locking lever 27, the support sleeve 15 is also retracted, so that the spring tongues 12 can be moved inward again due to their elasticity.

Figure 12B:
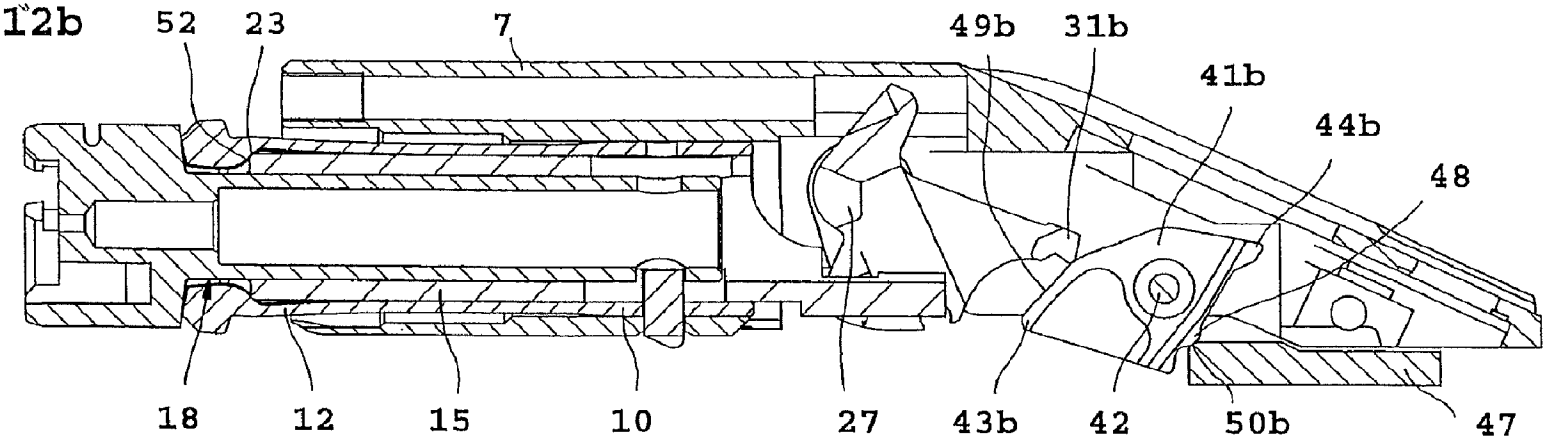
FIGS. 12*a*, 12*b*: the breech during the opening process with a still locked locking sleeve.
Figure 12A:
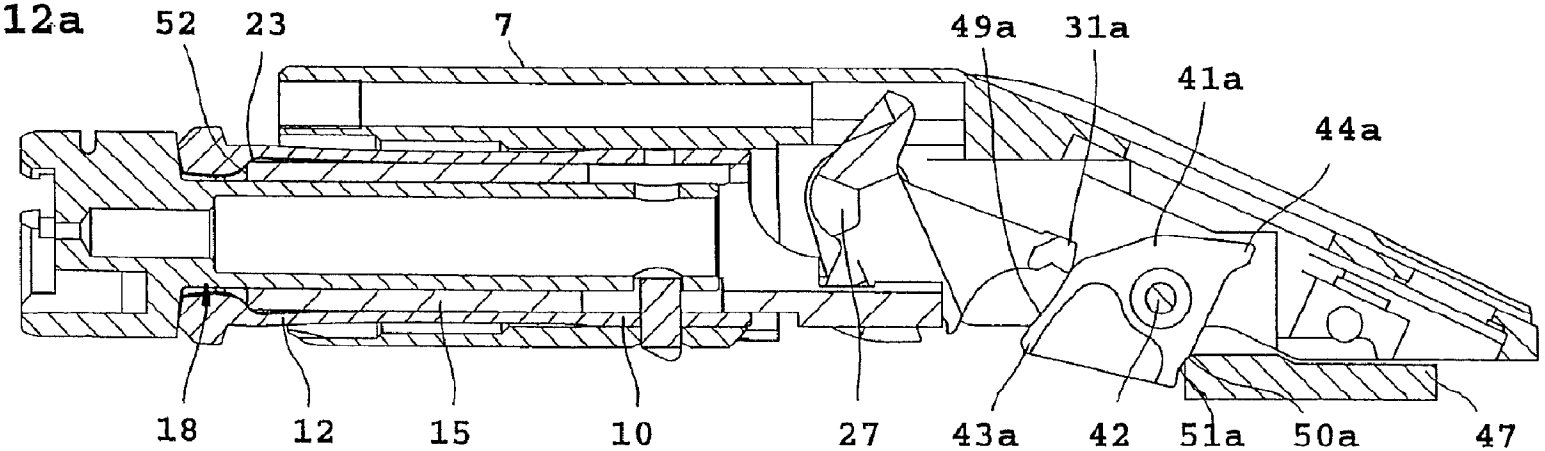

For the further retraction of the bolt handle 29, rear locking shoulders 31*a* and 31*b* of the locking lever 27 according to FIGS. 12*a* and 12*b* are lifted farther, so that the left cam element 41*a* is also rotated. Only when the spring tongues 12 of the locking sleeve 10 are located in the radially inner unlocked position is the lock guide 7 released for displacement towards the rear.

When the bolt handle 29 is retracted, the upward projecting tab 36 of the locking lever is also rotated forward and presses on the head 38 of the releasing pin 40 which is shown in FIG. 1, and which is therefore pushed forward against the barrel 1 and assists the opening of the breech 2 when a cartridge is jammed.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

The invention claimed is:

1. A breech portion for a repeating rifle comprising:

a) a lock guide;

b) a bolt head arranged in the lock guide;

c) a locking sleeve arranged concentric to the bolt head; the locking sleeve having a plurality of locking elements that are moved by an expansion device between an inner unlocked position and an outer locked position; and d) a locking lever arranged in the lock guide and activated by a bolt handle; the locking lever associated with:

i) a first cam element rotated in the lock guide and having a rear contact surface for support against a fixed control element;

ii) a second cam element rotated independently of the first cam element; and iii) a rear control cam element for support against the fixed control element.

2. The breech portion according to claim 1, wherein the first and the second cam elements are supported on a common transverse shaft and arranged in the lock guide, so that they rotate freely.

3. The breech portion according to claim 1, wherein the first and the second cam elements each have a rear control shoulder for engagement with control surfaces on the fixed control element.

4. The breech portion according to claim 1, wherein at least one of the first and the second cam elements has a front catch tab for engagement with the locking lever.

5. The breech portion according to claim 4, wherein the locking lever comprises two parallel legs with at least one of the two parallel legs having a locking shoulder for engagement with at least one front catch tab of the first and the second cam elements.

6. The breech portion according to claim 1, wherein the expansion device is made from a support sleeve that is connected by means of a shoulder to the locking lever and that is led with a front end into contact with ramp beveling on spring tongues of the locking sleeve.

7. The breech portion according to claim 6, wherein the support sleeve is arranged so that it moves in an axial direction between a rear part of the bolt head and the locking sleeve.

* * * * *